US009543719B2

(12) United States Patent
Bartholomew et al.

(10) Patent No.: US 9,543,719 B2
(45) Date of Patent: Jan. 10, 2017

(54) ELECTRICAL CONNECTOR FOR A VEHICLE

(71) Applicant: Deere & Company, Moline, IL (US)

(72) Inventors: Darin E. Bartholomew, Davenport, IA (US); Christopher L. Bradshaw, Sherrard, IL (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 14/510,717

(22) Filed: Oct. 9, 2014

(65) Prior Publication Data

US 2016/0104968 A1 Apr. 14, 2016

(51) Int. Cl.

| | |
|---|---|
| ***H01R 13/447*** | (2006.01) |
| ***H01R 24/76*** | (2011.01) |
| ***H01R 13/639*** | (2006.01) |
| *H01R 107/00* | (2006.01) |

(52) U.S. Cl.

CPC ..... *H01R 24/76* (2013.01); *H01R 13/6395* (2013.01); *H01R 13/447* (2013.01); *H01R 2107/00* (2013.01)

(58) Field of Classification Search

CPC ..... H01R 13/447; H01R 13/5213; H01R 2201/26; Y10T 16/54028

USPC ..... 439/142, 157, 310, 372, 357, 358

See application file for complete search history.

(56) References Cited

U.S. PATENT DOCUMENTS

| | | | | |
|---|---|---|---|---|
| 6,827,594 | B1 | 12/2004 | Davis et al. | |
| 6,840,782 | B1 * | 1/2005 | Borden | H01R 4/643 439/92 |
| 8,535,071 | B1 | 9/2013 | Mueller | |
| 8,888,515 | B2 * | 11/2014 | Hachadorian | H01R 13/5213 439/142 |
| 8,939,785 | B2 * | 1/2015 | Chiu | H01R 13/621 439/333 |
| 2007/0072461 | A1 | 3/2007 | Williams et al. | |
| 2011/0056723 | A1 | 3/2011 | Slippy et al. | |
| 2013/0130525 | A1 | 5/2013 | Hachadorian | |
| 2014/0377970 | A1 * | 12/2014 | Crovetti | H01R 13/5213 439/131 |

FOREIGN PATENT DOCUMENTS

| | | |
|---|---|---|
| EP | 0568030 A1 | 11/1993 |
| EP | 1686658 A2 | 8/2006 |
| WO | 2013119276 A1 | 8/2013 |

OTHER PUBLICATIONS

Search Report issued in counterpart application No. GB1516773.7, dated Mar. 1, 2016 (4 pages).

* cited by examiner

*Primary Examiner* — Amy Cohen Johnson
*Assistant Examiner* — Matthew T Dzierzynski

(57) ABSTRACT

An electrical connector comprises a dielectric body having a socket. A plurality of pivotable arms are hinged to the dielectric body. A releasable locking mechanism holds the pivotable arms in a locked position that releases with an outward pulling force exceeding a threshold force. The releasable locking mechanism comprises two or more latch members that are biased by corresponding springs against the corresponding pivotable arms. Each pivotable arm has a protrusion that divides a first region from a second region of the pivotable arm.

20 Claims, 4 Drawing Sheets

ELECTRICAL CONNECTOR FOR A VEHICLE

FIELD OF THE INVENTION

This invention relates to an electrical connector for a vehicle.

BACKGROUND OF THE INVENTION

An electrical connector, such as an electrical connector that conforms to the International Standards Organization (ISO) 11783 standard or "ISO Bus standard" may be used to provide an electrical connection between an off-road vehicle (e.g., tractor) and its implement. For example, an electrical connector on a tractor may be coupled to a plug associated with a towed implement to provide electrical signals or electrical power to the implement. If vehicle is disconnected from the implement and the operator forgets to unplug the plug, there is a need for the plug to break-away or release from the electrical connector without damaging the electrical connector, the plug, or its associated wiring harness.

SUMMARY OF THE INVENTION

In accordance with one embodiment, an electrical connector comprises a dielectric body having a socket. A pivotable retainer or plurality of pivotable arms are hinged to the dielectric body. A releasable locking mechanism holds the pivotable retainer or pivotable arms in a locked position that releases with an outward pulling force exceeding a threshold force. The releasable locking mechanism comprises two or more latch members that are biased by corresponding springs against the corresponding pivotable retainer or corresponding pivotable arms. Each pivotable arm has a protrusion (e.g., ridge) that divides a first region from a second region of the pivotable arm.

BRIEF DESCRIPTION OF THE DRAWINGS

In any or all of the drawings like reference numbers indicate like elements or features.

DESCRIPTION OF THE PREFERRED EMBODIMENT

Figure 1:
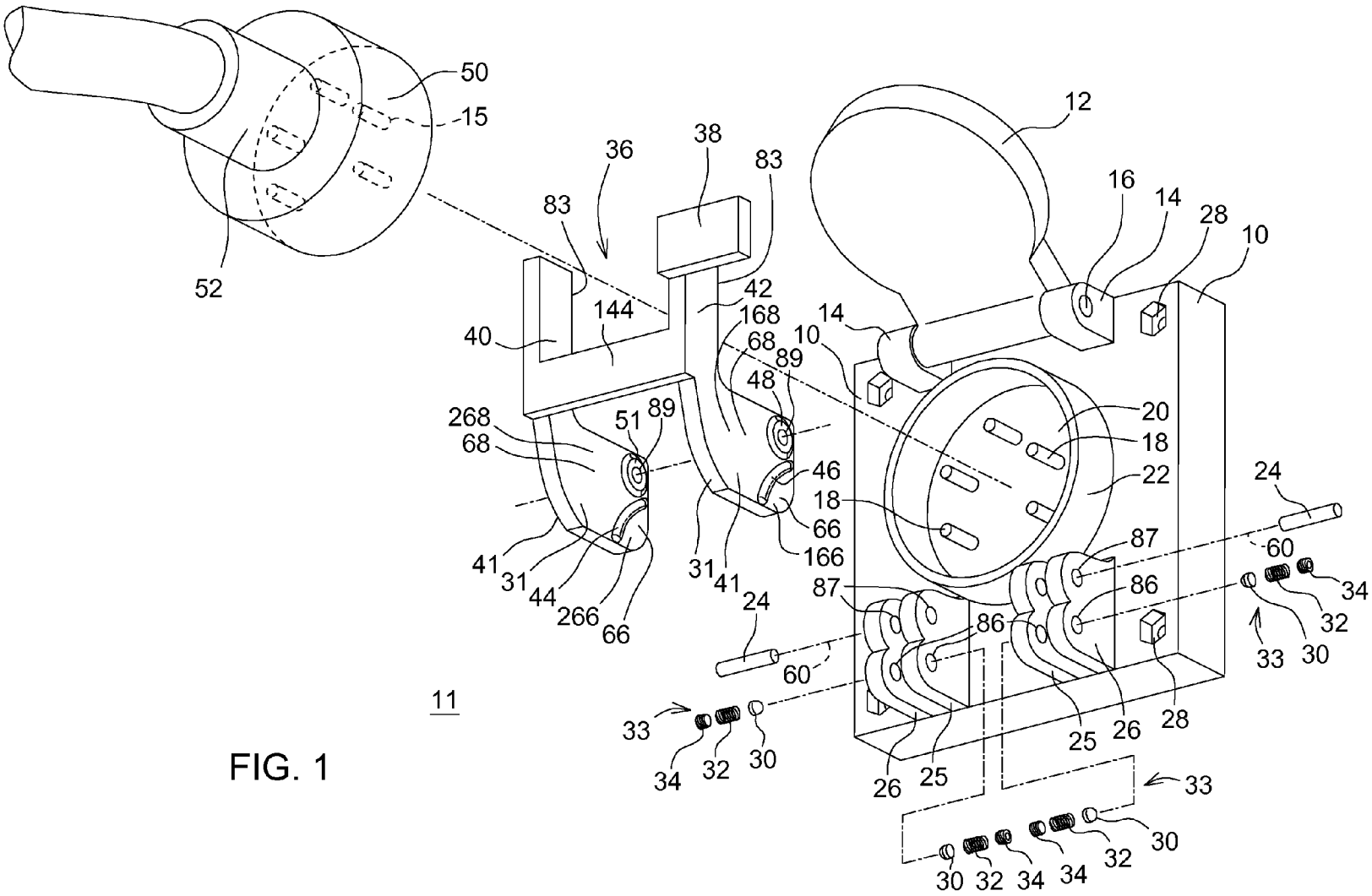
FIG. 1 is a perspective exploded view of one embodiment of the electrical connector, which shows an associated plug.

In accordance with one embodiment, FIG. 1 comprises an electrical connector 11. The electrical connector 11 may be mounted to a vehicle, vehicle chassis or equipment via holes 28 and/or associated fasteners. The electrical connector 11 comprises a dielectric body 10 having a socket 22. In one embodiment, a rotatable cover 12 is pivotally connected to the dielectric body 10 at hinge 14 by pin 16, or otherwise. As illustrated, pin 24 is secured (e.g., press-fitted) in or into bore 87. In one embodiment, the rotatable cover 12 may be resiliently biased by a spring (not shown) toward a closed position that conceals a recess 20 within the socket 22.

A pivotable retainer 36 or a plurality of pivotable arms (40, 42) are hinged to the dielectric body 10 at hinge structure (25, 26). A releasable locking mechanism 33 holds the pivotable retainer 36 or pivotable arms (40, 42) in a locked position that releases with an outward pulling force exceeding a threshold force. In one embodiment, the releasable locking mechanism 33 comprises two or more latch members 30 that are biased by corresponding springs 32 against the corresponding pivotable arms (40, 42). Each pivotable arm (40, 42) has a protrusion (44, 46) or ridge that divides a first region 66 from a second region 68 of the pivotable arm. In one embodiment, the first region 66 comprises a first outer region 166 and a first inner region 266; and the second region 68 comprises a second outer region 168 and a second inner region 268. Further, an additional first region and second region are on the opposite sides of the pivotable arms (40, 42), where the view of the opposite sides of are obstructed in FIG. 1.

In one configuration, a connector plug 50 is adapted for insertion into the socket 22, where a mating surface 83 of the pivotable arms (40, 42) contacts the connector plug 50 if the connector plug 50 is inserted into a recess 20 of into the socket 22. The recess 20 may contain one or more conductors 18 or pins for electrical connection, mechanical connection, or both to one or more corresponding mating conductors 15 (e.g., generally tubular conductors or hollow conductors) associated with the plug 50. The connector plug 50 is associated with a cable 52 or wiring harness with wires or conductors connected to one or more of the mating conductors 15. The pivotable retainer 36 can be retained in a locked position or locked state by releasable locking mechanism 33, such as the locked state illustrated in FIG. 6. In an open position or an open state, the pivotable retainer 36 can rotate about a pivot point or hinge structure (25, 26) on the dielectric body 10. In the locked state, the pivotable retainer 36 and the associated locking mechanism 33 hold a connector plug 50 in an inserted position in socket 22 and that releases to an open state when the connector plug 50 is pulled from the socket 22 with a force exceeding a threshold force, among other things. In one illustrative example, the threshold force is below a force that would damage, deform or fracture the plug 50 or its associated cable 52.

Pivotable Arms

Figure 2:
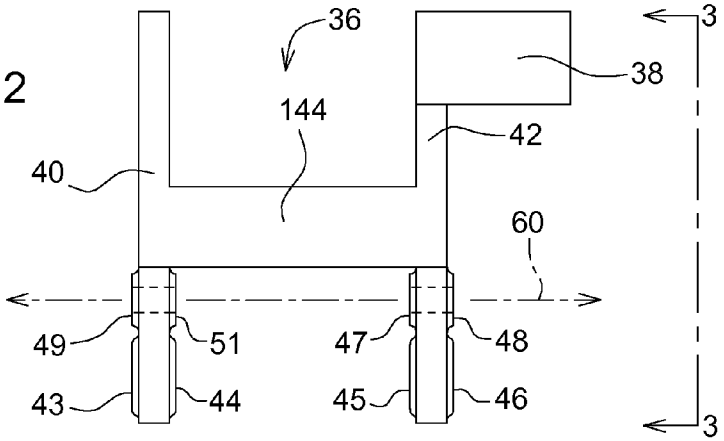
FIG. 2 is an enlarged view of a retainer of the electrical connector of FIG. 1.
Figure 6:
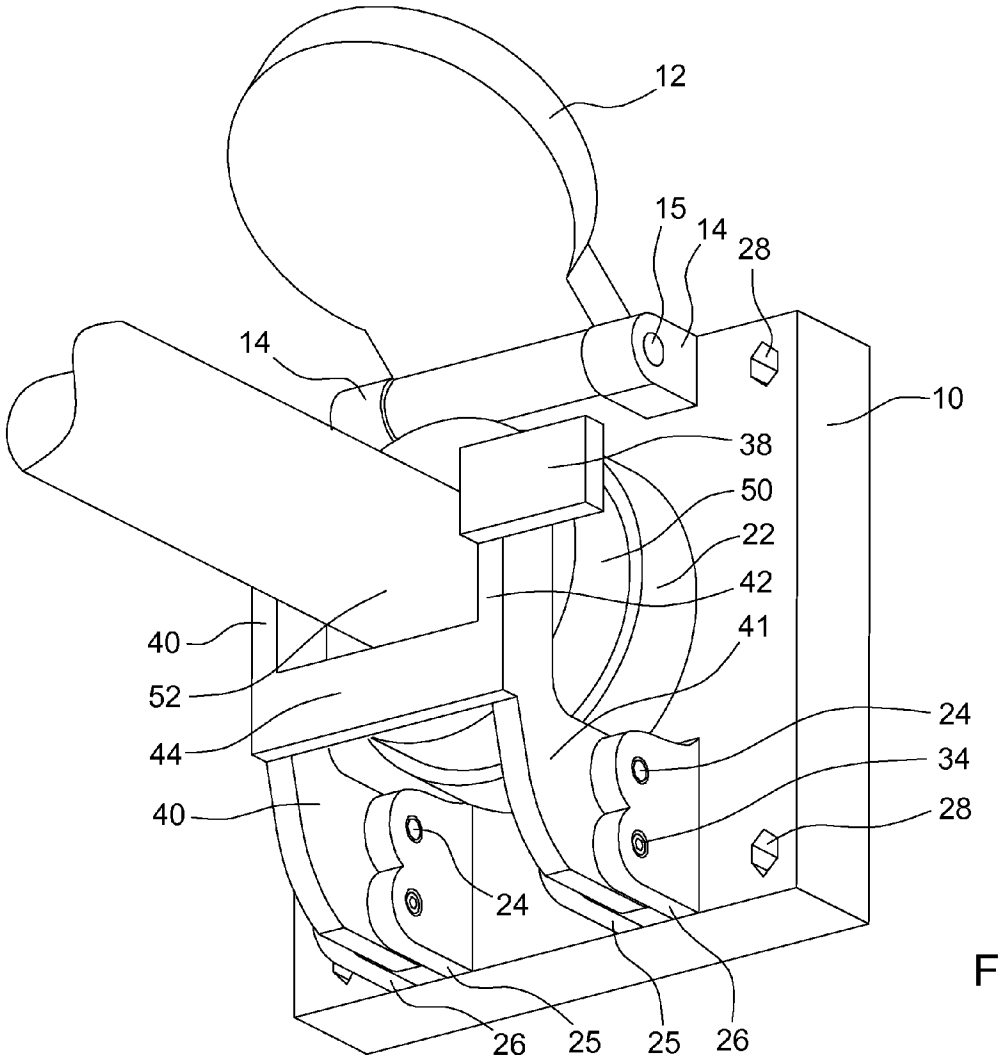
FIG. 6 is a perspective view of the assembled electrical connector connected to a plug.

In one embodiment, each pivotable arm (40, 42) has an inner protrusion (44, 45) and an outer protrusion (43, 46) as illustrated in FIG. 1 and FIG. 2. The inner protrusions (44. 45) and outer protrusions (43, 46) may comprise ridges or other elevated zones (e.g., with substantially curved, sloped, rectangular, triangular, or other geometrically shaped cross-sections) that extend above the adjacent surface of each pivotable arm. The outer protrusion (43, 46) is on an opposite side of the pivotable arm (40, 42) from the inner protrusion (44, 45). The inner protrusion 44 divides a first inner region 266 from a second inner region 268 of the pivotable retainer 36 or pivotable arm 40. The outer protrusion 46 divides a first outer region 166 from a second outer region 168 of the pivotable arm 42. In one configuration as illustrated in FIG. 1, FIG. 2 and FIG. 6, the pivotable arms are connected by a cross member 144, wherein one pivotable arm 42 terminates in a lever 38.

Latch Members

The electrical connector 11 has an improved releasable locking mechanism 33 that includes two or more latch members 30 (e.g., transversly slidable pins) that are biased by corresponding springs 32 against inner surfaces 31, or outer surfaces 41, or both of corresponding pivotable arms (40, 42). In the embodiment illustrated in FIG. 1, there are two latch members 30 per each pivotable arm (40, 42). However, as few as one latch member 30 per each pivotable arm (40, 42) may be used for the releasable locking mechanism 33. In one embodiment, the latch members 30 comprise transversely slidable pins. For example, in one configuration, one end of the slidable pin is substantially hemispherical or rounded with chamfered edges.

Springs

Each set of latch members 30 and springs 32 are positioned in corresponding bores 86 of a fulcrum portion or hinge structure (25, 26); a retainer 34 (e.g., threaded retainer) can retain each set of latch members 30 and springs 32 in its corresponding bore 86. In one embodiment, the tension of the spring or releasable threshold force may be adjusted by one or more of the following: the number of springs 32, the number of latch members 30, the length of the latch members 30, the spring tension or biasing resilient force of each spring, the dimension or length or spring constant of each spring, the height, slope or profile of the protrusion, or a position of the retainer 34 (e.g., set screw) with respect to the bore 86 or the adjustable compressive force that the retainer 34 can place on the spring 32 to adjust the biasing resilient force of the spring 32.

The electrical connector 11 functions as follows. The electrical connector 11 has a releasable locking mechanism 33 that has a locked state where the pivotable retainer 36 presses against the plug 50 seated in socket 22, such as the locked state illustrated in FIG. 6.

Figure 4:
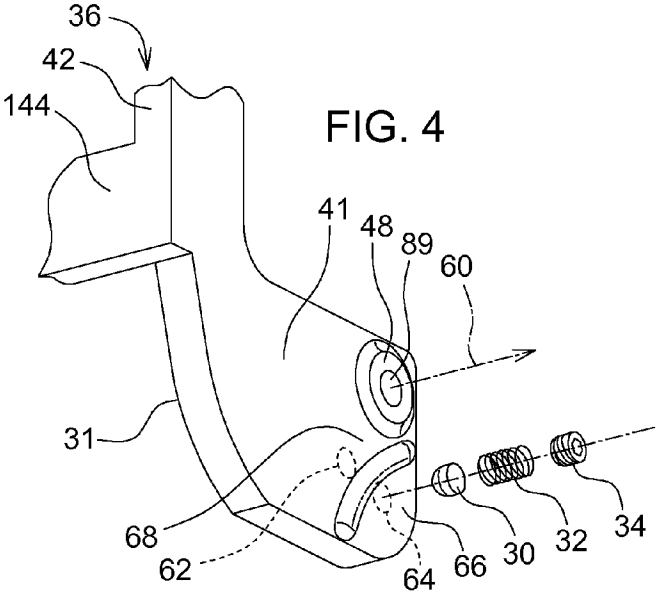
FIG. 4 is a perspective view exploded view of the retainer of FIG. 1.

Each pivotable arm (40, 42) has a protrusion (44, 46) that divides a first region 66 from a second region 68. In one embodiment, the first region 66 comprises a first outer region 166 and a first inner region 266; and the second region 68 comprises a second outer region 168 and a second inner region 268. If the pivotable arms (40,42) or pivotable retainer 36 is in a closed state that retains a plug 50 inserted into the socket 22, each latch member 30 is biased against a first region 66, such as first contact area 64 (FIG. 4). The first contact area 64 generally corresponds in size and shape to the mating surface area of an end of the latch member 30. The protrusion (44, 46) may have a ledge, cliff, ramp or slope that bounds the first region 66.

If the pivotable arms (40, 42) or pivotable retainer 36 is in an open state that does not retain a plug 50 of the connector 11 in the socket 22, the latch member 30 is biased against a second region 68, such as second contact area 62 (FIG. 4). The second contact area 62 corresponds generally in size and shape to the mating surface area of an end of the latch member 30. The latch member 30 retracts (e.g., within bore 86 of hinge structure 25, 26) to slide or move past the protrusion (44, 46) in a transition between the open state and the closed state of the pivotable retainer 36. To release the pivotable retainer 36 and the associated latch members 30 from the closed state, an applied force pulling outward on the lever 38 away from the dielectric body 10 or the applied force pulling outward on the plug 50 exceeds a threshold force to slide or move each biased latch member 30 over and past one or more protrusions (44, 46). In one embodiment, there are four latch members 30, four corresponding springs 32, and four protrusions (43, 44, 45, 46) on the arms (FIG. 4). In other embodiments, such as the embodiment of FIG. 7, there are two latch members 30 and two corresponding springs 32 on the pivotable arms (40, 42). Accordingly, the release force can be impacted by one or more of the following factors: (1) the number of latch members 30; (2) spring constant of each spring; (3) profile or slope angle of the protrusion (44, 46), such as a ramp, slope, ledge, or cliff; (4) tightness or position of the retainer 34 in the bore 86 to compress one or more springs 32; and (5) length of each latch member 30 and the shape of the interface surface (e.g., substantially hemispherical) at one end of the latch member 30 that faces or contacts a corresponding surface of the pivotable arms (40, 42).

The releasable locking mechanism 33 has a released state or open state that can occur after a transition from the locked state. The releasable locking mechanism 33 releases when: (1) a connector plug 50 is pulled from the connector socket 22 with a force exceeding a threshold force, or (2) when a user releases lever 38 (of the pivotable retainer 36) by pulling it with a force exceeding the threshold force. As indicated above, the threshold force can be affected by the geometry, shape and height of the protrusion (44, 46) above the inner surface 31 and outer surface 41, among other factors.

Given a fixed biasing force associated with a spring 32 or an adjustable biasing force associated with the spring 32 and retainer 34, the higher the height of the protrusion (44, 46) above the inner surface 31, the greater the force to transition from the closed state to the open state of the pivotable retainer 36. Conversely, the lower the height of the protrusion (44, 46) above the inner surface 31, the lesser the force to transition from the closed state to the open state of the pivotable retainer 36. The greater the slope of the protrusion that bounds the first region 66, the greater the force to transition from the closed state to the open state of the pivotable retainer 36. The lesser the slope of the protrusion that bounds the first region 66, the lesser the force to transition from the closed state to the open state of the pivotable retainer 36. In one embodiment, the threshold force, or corresponding protrusion geometry, shape and height, is established to avoid damage to the wiring harness if an implement is disconnected from a vehicle at a hitch and remains connected at the wiring harness-connector 11 interface. To reset the pivotable retainer 36 from the open state to the closed state, the user closes the pivotable retainer 36 to seat on the inserted plug 50 and overcomes the force associated with one or more latch members 30 clearing one or more respective protrusions (44, 46).

FIG. 2 is an enlarged view of a pivotable retainer 36 of the electrical connector 11 of FIG. 1. FIG. 2 shows the pivotable arms (40, 42) that are connected together by a transverse portion 44. Further, as illustrated, one of the pivotable arms (40, 42) terminates in a lever 38, although both arms could terminate in levers or the levers could be omitted altogether in alternate embodiments. The pivotable arm (40, 42) pivots along an axis 60 that intercepts a bore 89 in each pivotable arm (40, 42) and bore 87 in hinge structure (25, 26). The bore 89 may have a raised annular portion (47, 48, 49, 51) or an annular stand-off that is approximately the peak height of the corresponding protrusion (45, 46, 43, 44, respectively) above the adjacent surface (e.g., first region 66 and second region 68) of the pivotable arms (40, 42). In an alternate embodiment, shown in FIG. 7 bore 89 is associated with a washer 92 or annular spacer with an axial height of approximately the peak height of the protrusion (44, 46) above the adjacent surface (e.g., first region 66 and second region 68) of the pivotable arms (40, 42). The raised annular portion (47, 48, 49, 51), an annular stand-off, or an annular washer prevents lateral or axial movement (along the axis) of the pivotable arms (40, 42) with respect to the fulcrum portion, and facilitates proper alignment between the protrusions and corresponding latch members 30.

As illustrated in FIG. 2, each pivotable arm has an inner protrusion (44, 45) and an outer protrusion (43, 46), although in an alternate embodiment, each pivotable arm may have either an inner protrusion (44, 45) or an outer protrusion (43, 46).

Figure 3:
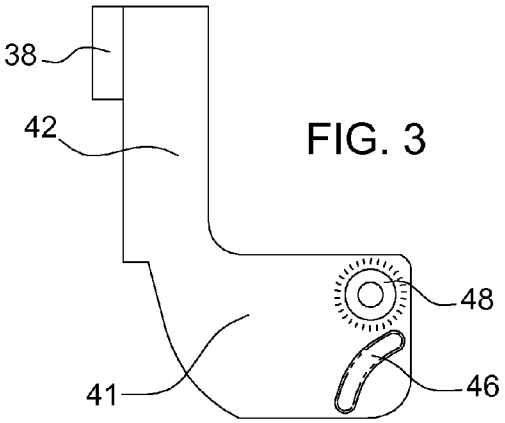
FIG. 3 is an enlarged side view of the lever of FIG. 3 as viewed along reference line 3-3 of FIG. 2.

FIG. 3 is an enlarged side view of the lever of FIG. 3 as viewed along reference line 3-3 of FIG. 2. FIG. 3 illustrates the raised annular portion 48 and an illustrative example of the outer protrusion 46 of a pivotable arm 42. As shown, the outer protrusion 46 has an arc or curved shape, although the outer protrusion (43, 46) or inner protrusion (44, 45) may have a substantially linear or any other suitable shape. A first region 66 lies on a first side of the protrusion and a second region 68 lies on second side of the protrusion, where the protrusion protrudes outward with respect to the first region 66 and the second region 68.

FIG. 4 is a perspective view exploded view of the pivotable retainer 36 of FIG. 1. FIG. 4 is similar to FIG. 3 and like reference numbers indicate like elements. FIG. 4 further illustrates, an exploded perspective view of the latch member 30, the spring 32, and the retainer 34 which are exposed from their normal installed position in a bore 86 of the fulcrum portion or hinge structure (25, 26). If the pivotable retainer 36 or lever 38 is in a closed position or locked state (e.g., with the plug 50 connected to the connector 11) the latch member 30 makes contact with the first region 66 at or near a first contact area 64 or closed contact area, illustrated by dashed lines in FIG. 4. However, if the pivotable retainer 36 or lever 38 is in an open position or released state (e.g., with the plug 50 disconnected from the connector 11), the latch member 30 makes contact with the second region 68 at or near a second contact area 62 or open contact area, illustrated by dashed lines in FIG. 4.

Figure 5B:
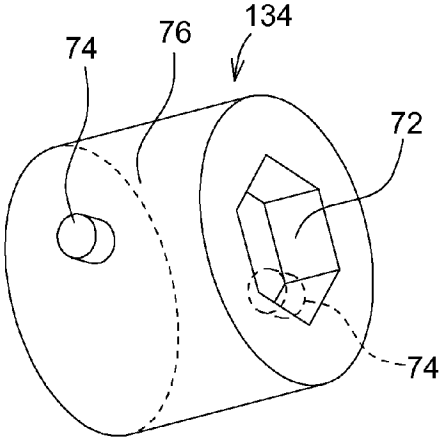
FIG. 5B is perspective view of another embodiment of a retainer.
Figure 5A:
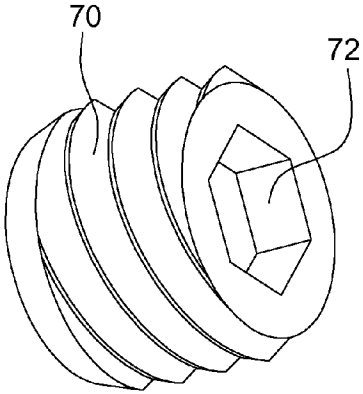
FIG. 5A is perspective view of one embodiment of a retainer (e.g., set screw).

FIG. 5A is perspective view of the retainer 34 (e.g., set screw). As illustrated, the retainer 34 comprises a set screw (e.g., an Allen-head, set screw) with threads 70 and mechanical port 72 for rotating the retainer 34 within a bore 86, although any other suitable retainer may be used. For example, FIG. 5B illustrates an alternate retainer 134 with two radially extending pins 74, from substantially cylindrical surface 76, to retain, lock, support, or secure the alternate retainer 134 of FIG. 5B, in a bore, such as modified bore (not shown) that has two axial slots (in an unthreaded variant or equivalent of bore 86) that connect to an annular groove, to allow a retainer 134 with two generally, radially extending pins 74 to be inserted into the axial slots and pushed inward into the annular groove and then rotated within the annular groove to secure or lock the alternate retainer 134 in place in the modified bore.

FIG. 6 is a perspective view of the assembled electrical connector 11 connected to a plug 50 in a locked state. Like reference numbers indicate like elements in FIG. 1 and FIG. 6. In one configuration, a connector plug 50 is adapted for insertion into the socket 22, and where a mating surface 83 of the pivotable arms (40, 42) contacts the connector plug 50 if the connector plug 50 is inserted into the socket 22. Accordingly, the releasable locking mechanism 33 is hinged about a pivot point or hinge structure (25, 26) on the dielectric body 10 to hold a connector plug 50 in an inserted position and that releases when the connector plug 50 is pulled from the socket 22 with a force exceeding a threshold force, or when the lever 38 is pulled outward with a force exceeding a threshold force.

Figure 7:
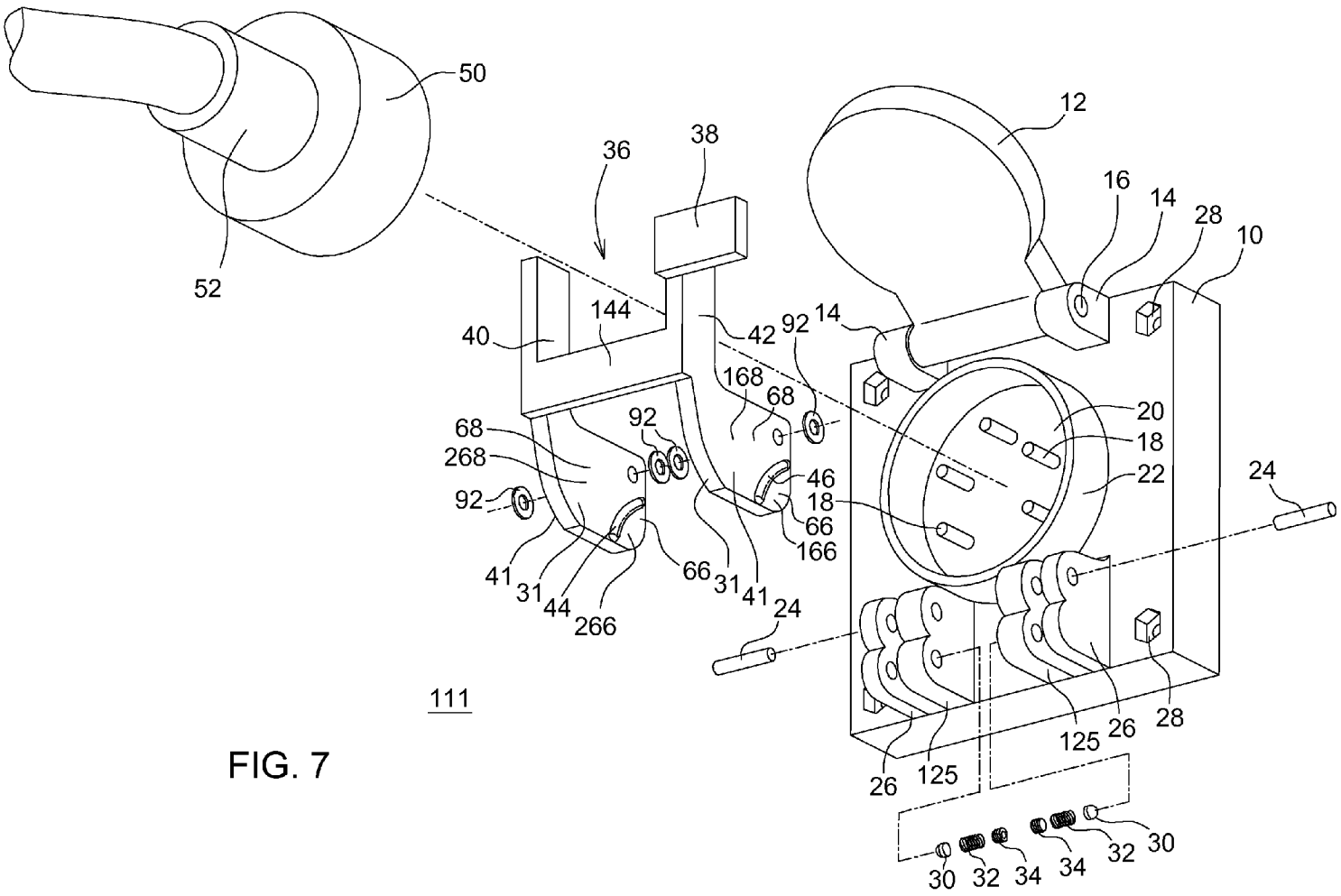
FIG. 7 is a perspective exploded view of another embodiment of the electrical connector, which shows an associated plug.

The electrical connector 111 of FIG. 7 is similar to the electrical connector 111 of FIG. 1, except the electrical connector 111 of FIG. 7 replaces the raised annular portions (48, 51) with washers 92 or annular spacers. Similarly, raised annular portions (47, 49) that are visible in FIG. 4 are replaced by washers 92 or annular spacers. Further, the electrical connector 111 of FIG. 7 only uses two sets of the latch members 30, springs 32 and retainers 34, instead of four sets of latch members 30, springs 32 and retainers 34, as in FIG. 1. The inner hinge structures 125 of FIG. 7 are shown with greater thickness than the inner hinge structures 25 of FIG. 1; the thickness of the hinge structures (25, 125) may vary from one embodiment to another and may vary to accommodate axially longer or shorter springs 32 or axially longer or shorter latch members 30 in any embodiment, for example.

Having described the preferred embodiment, it will become apparent that various modifications can be made without departing from the scope of the invention as defined in the accompanying claims.

The following is claimed:

1. An electrical connector comprising:

a dielectric body having a socket;

a plurality of pivotable arms hinged to the dielectric body;

a releasable locking mechanism to hold the pivotable arms in a locked position that releases with an outward pulling force exceeding a threshold force;

wherein the releasable locking mechanism comprises two or more latch members that are biased by corresponding springs against the corresponding pivotable arms, each pivotable arm having a sloped protrusion that extends above a surface of each pivotable arm and that divides the surface of each pivotable arm into a first region and a second region that are coplanar.

2. The electrical connector according to claim 1 wherein the latch members comprise transversely slidable pins.

3. The electrical connector according to claim 2 wherein one end of each of the slidable pins is substantially hemispherical.

4. The electrical connector according to claim 1 wherein each pivotable arm, among the plurality of pivotable arms, has an inner protrusion and an outer protrusion, the outer protrusion on an opposite side of the pivotable arm from the inner protrusion, the inner protrusion dividing a first inner region from a second inner region of the pivotable arm, the outer protrusion dividing a first outer region from a second outer region of the pivotable arm.

5. The electrical connector according to claim 4 wherein latch members comprise two latch members per each pivotable arm.

6. The electrical connector according to claim 1 wherein sets of latch members and springs are in corresponding bores of a fulcrum portion, and wherein a threaded retainer retains each of the sets in its corresponding bore.

7. The electrical connector according to claim 1 wherein the pivotable arms are connected by a cross member and wherein one pivotable arm terminates in a lever.

8. The electrical connector according to claim 1 further comprising: a connector plug for insertion into the socket, and wherein a mating surface of the pivotable arms contacts the connector plug if the connector plug is inserted into the socket.

9. The electrical connector according to claim 1 further comprising: a rotatable cover pivotally connected to the dielectric body.

10. An electrical connector comprising:

a dielectric body having a socket;

a releasable locking mechanism to hold pivotable arms in a locked position that release with an outward pulling force exceeding a threshold force; wherein the releasable locking mechanism comprises two or more latch members that are biased by corresponding springs against corresponding pivotable arms, each pivotable arm having a sloped protrusion that extends above a surface of each pivotable arm and that divides the surface of each pivotable arm into a first region and a second region that are coplanar.

11. An electrical connector for connecting to a connector plug, the electrical connector comprising:

a dielectric body having a socket;

a releasable locking mechanism hinged about a pivot point on the dielectric body to hold a connector plug in an inserted position and that releases when the connector plug is pulled from the socket with a force exceeding a threshold force; wherein the releasable locking mechanism comprises two or more latch members that are biased by corresponding springs against corresponding pivotable arms, each pivotable arm having a sloped protrusion that extends above a surface of each pivotable arm and that divides the surface of each pivotable arm into a first region and a second region that are coplanar.

12. The electrical connector according to claim 11 wherein each one of the latch members comprises a transversely slidable pin.

13. The electrical connector according to claim 12 wherein one end of the slidable pin is substantially hemispherical.

14. The electrical connector according to claim 11 wherein each pivotable arm has an inner protrusion and an outer protrusion, the outer protrusion on an opposite side of the pivotable arm from the inner protrusion, the inner protrusion dividing a first inner region from a second inner region of the pivotable arm, the outer protrusion dividing a first outer region from a second outer region of the pivotable arm.

15. The electrical connector according to claim 14 wherein latch members comprise two latch members per each pivotable arm.

16. The electrical connector according to claim 14 further comprising a threaded retainer for a set of latch members and springs in a bore.

17. The electrical connector according to claim 11 wherein the pivotable arms are connected by a cross member and wherein one pivotable arm terminates in a lever.

18. The electrical connector according to claim 11 wherein an mating surface of the pivotable arms contacts the connector plug if the connector is closed.

19. The electrical connector according to claim 11 further comprising: a rotatable cover pivotally connected to the dielectric body.

20. The electrical connector according to claim 19 wherein the cover has a closed position that covers or protects the socket.

* * * * *